US006638095B1

(12) United States Patent
Chen et al.

(10) Patent No.: US 6,638,095 B1
(45) Date of Patent: Oct. 28, 2003

(54) ZIF SOCKET HAVING ACTUATION MEMBER FOR REDUCED STRESS

(75) Inventors: Sen-Jong Chen, Tu-Chen (TW); Ren-Chih Li, Tu-Chen (TW); Yao-Chi Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/288,809

(22) Filed: Nov. 5, 2002

Related U.S. Application Data

(63) Continuation-in-part of application No. 10/161,882, filed on Jun. 3, 2002.

(30) Foreign Application Priority Data

Jul. 10, 2002 (TW) ..... 91210501 U

(51) Int. Cl.[7] ..... H01R 13/625
(52) U.S. Cl. ..... 439/342
(58) Field of Search ..... 439/342, 259–270

(56) References Cited

U.S. PATENT DOCUMENTS 5,679,020 A * 10/1997 Lai et al. ..... 439/342
6,280,223 B1 8/2001 Lin
6,544,065 B1 * 4/2003 Howell et al. ..... 439/342

* cited by examiner

*Primary Examiner*—Lynn Feild
*Assistant Examiner*—Son V. Nguyen
(74) *Attorney, Agent, or Firm*—Wei Te Chung

(57) ABSTRACT

An electrical socket 1 includes a dielectric base 10, a number of conductive contacts 70 retained in the base, a cover 20 and an actuation member 30 for moving the cover with respect to the base. The base defines a receiving chamber 12 for receiving a cam shaft 32 of the actuation member. The cam shaft provides a cam member 33 having a driving side 330 and a plane side 332 opposite to the driving side. The driving side includes a start portion 3300 at one end thereof, an end portion 3302 at the other end thereof and a tip portion 3304 between the start portion and the end portion. The distance from the tip portion of the driving side to the plane side is a maximum distance, while the distance from either the start portion or the end portion to the plane side is smaller than the maximum distance.

8 Claims, 6 Drawing Sheets

ZIF SOCKET HAVING ACTUATION MEMBER FOR REDUCED STRESS

CROSS-REFERENCE TO RELATED APPLICATION

This patent application is a continuation-in-part of the Application of U.S. patent application Ser. No. 10/161,882 filed Jun. 3, 2002, entitled "ZIF SOCKET CONNECTOR" and assigned to the same assignee as the present invention.

BACKGROUND OF THE INVENTION

1. Field of the Invention

The present invention is related to an electrical socket, and more particularly to a zero insertion force (ZIF) socket for electrically assembling an integrated circuit chip to a printed circuit board (PCB), wherein the ZIF socket has an actuation member for motivating a cover relative to a base thereof.

2. Description of Related Art

ZIF sockets are widely used in computer industry for electrically assembling a central processing unit (CPU) component to a printed circuit board. The ZIF socket usually comprises a cover defining a plurality of upper passageways therein and slidably engaging with a base having a corresponding number of lower passageways retaining contacts therein. The ZIF socket further includes an actuation member for moving the cover with respect to the base and the actuation member has an operating lever and a cam shaft providing a cam member. When the operating lever is oriented vertically to the base, the pins of the CPU component can be freely inserted into the socket. Successively, the operator manually pushes the operating lever downward to a horizontal position, during which the cam member moves the cover together with the CPU component horizontally and the pins of the CPU component are moved to engage with the corresponding contacts in the base. Reversely, when the operating lever is moved from the horizontal position back to the vertical position, the cover together with the CPU component is moved horizontally in a reverse direction. Therefore, the engagement between the contacts of the socket and the pins of the CPU component is released, and the CPU component can be detached from the socket.

U.S. Pat. No. 6,280,223 discloses such a ZIF socket having an actuation member. Referring to FIG. 5, the actuation member 30' includes a cam shaft 32' and an operating handle 31' perpendicularly extending from the cam shaft 32'. The cam shaft 32' has a cam member 33'. The cam member 33' has a driving side 330' for driving a cover of the socket to move with respect to a base thereof and a plane side 332' opposite to the driving side 330'. The driving side 330' is a slope plane and includes a start portion 3300' at one end thereof and an end portion 3302' at the other end thereof. From the start portion 3300' to the end portion 3302', the distance between the driving side 330' and the plane side 332' of the cam member 33' is the same. Referring to FIG. 6, when the operating handle 31 ' is oriented in a zero degree position, that is, the socket is in an open position, a displacement of the cover relative to the base is zero and accordingly a contact stress between the cam member 33' and a cover plate of the cover is zero. With the operating handle 31 ' rotated towards its final position continually, both the displacement of the cover relative to the base and the contact stress increase gradually following the increase of the rotated angle of the actuation member 30'. Therefore, when the socket is in a closed position, the displacement of the cover relative to the base is maximal, accordingly the contact stress between the cam member 33' and the cover plate of the cover arrives at a top peak. The cam member 33' is made of zinc alloy. When the socket is exposed to an elevated temperature due to the operation of the CPU component mounted on the cover, the high contact stress causes the cam member 33' to creep because of the poor creep strength of zinc alloy. The creep of the cam member 33' causes the cam member 33' to deform from its original configuration whereby the cam member 33' can no longer achieve its requested stroke when it is rotated to move the cover relative to the base. Accordingly, the pins of the CPU component can not be moved to correctly engage with the contacts in the closed position or totally disengage from the contacts in the open position of the socket.

Hence, it is requisite to provide an electrical socket with an improved actuation member to overcome the above-mentioned disadvantages.

SUMMARY OF THE INVENTION

Accordingly, the object of the present invention is to provide an electrical socket having an improved actuation member which can provide an effective stroke for the socket to ensure a reliable connection between the pins of an integrated circuit chip and conductive contacts of the socket.

In order to achieve the object set forth, a ZIF socket in accordance with the present invention is adapted for supporting an integrated circuit chip on a circuit board. The socket comprises a dielectric base defining an array of terminal passageways, a plurality of conductive contacts received in the terminal passageways, a cover slidably mounted on the base and an actuation member assembled between the cover and the base for moving the cover with respect to the base. The base defines a receiving chamber in a top surface thereof. The actuation member includes a cam shaft received in the receiving chamber and having a cam member for moving the cover with respect to the base. The cam member provides a driving side having a scraggy surface, and a plane side opposite to the driving side. The driving side comprises a start portion at one end thereof, an end portion at the other end thereof, and a tip portion between the start portion and the end portion. From the start portion to the end portion of the driving side, the distances between the driving side and the plane side are different. The distance from the tip portion of the driving side to the plane side is a maximum distance, while the distance from either the start portion or the end portion of the driving side to the plane side is smaller than the maximum distance, whereby a contact stress between the cam member and a cover plate of the cover is released when the socket is in a closed position.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
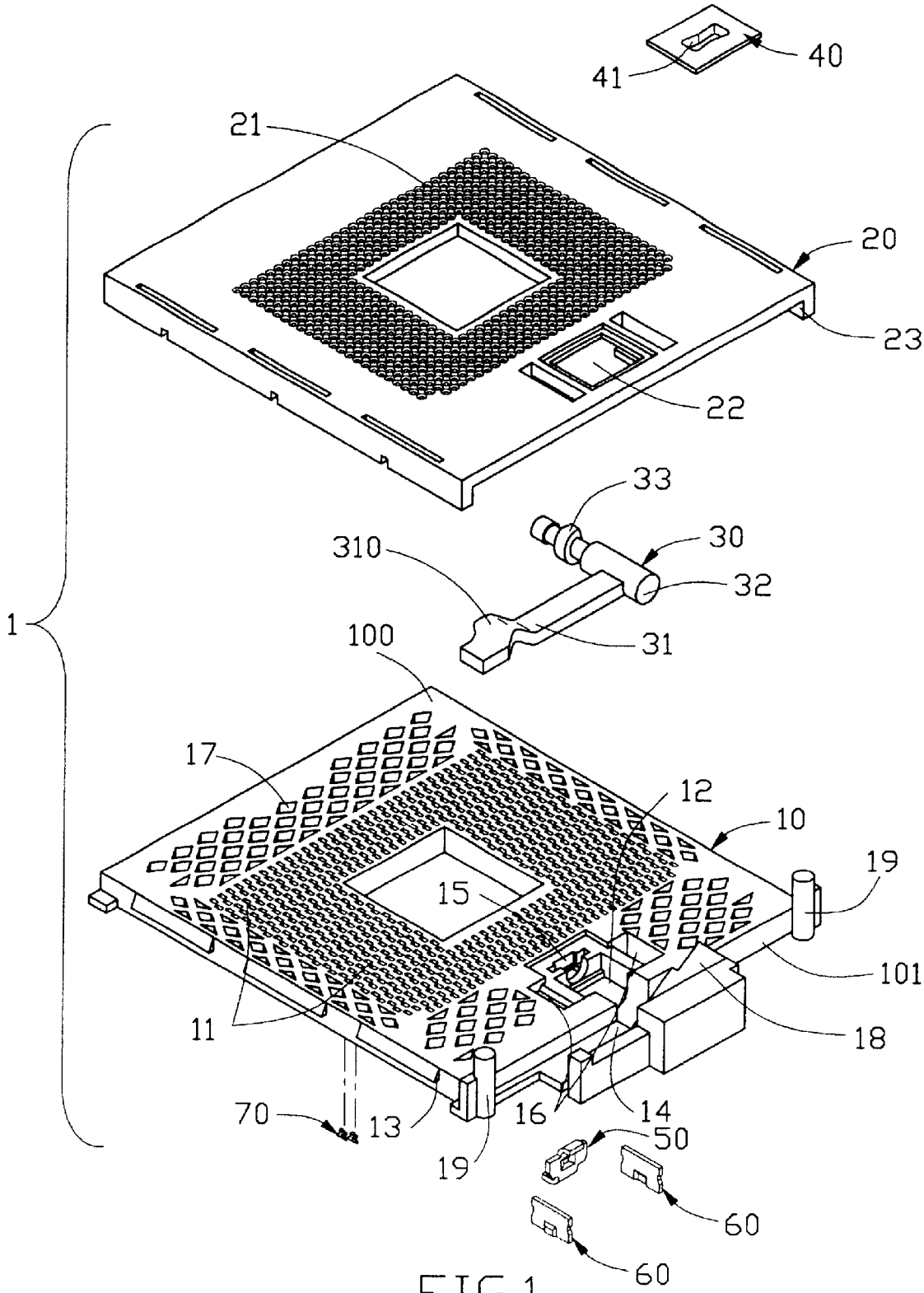
FIG. 1 is an exploded perspective view of a ZIF socket connector in accordance with the present invention.

Referring to FIG. 1 first, a ZIF socket 1 for electrically assembling a CPU package (not shown) to a printed circuit board (not shown) in accordance with the present invention comprises a dielectric base 10 adapted for being securely mounted onto the printed circuit board, a plurality of conductive contacts 70 retained in the base 10, a cover 20 movably mounted on the base 10, and an actuation member 30 assembled between the base 10 and the cover 20.

The dielectric base 10 defines an array of terminal passageways 11 for receiving a corresponding number of the conductive contacts 70, and an array of through holes 17 around the terminal passageways 11. The through holes 17 are devised for an optimal formation of the base 10 by plastic injection molding. A receiving chamber 12 is defined in a top surface 100 of the base 10 and among the through holes 17 thereof. A receiving slot 14 extends along a lateral side 101 of the base 10 and communicates with the receiving chamber 12. Additionally, the lateral side 101 of the base 10 forms an inclined block 18 at an end of the receiving slot 14 for preventing the actuation member 30 from over-rotating. A pair of stopping posts 19 is further formed at opposite ends of the lateral side 101. The base 10 has a plurality of guiding sections 13 on opposite longitudinal sides. The base 10 defines a pair of through slots 16 on two sides of the receiving chamber 12 through upper and lower surfaces thereof. The base 10 defines a receiving slit 15 therethrough proximate to the receiving chamber 12 and perpendicular to the through slots 16.

The cover 20 defines an array of pin holes 21 vertically corresponding to the terminal passageways 11 of the base 10 for insertion of pins of the CPU package therethrough. A through aperture 22 is defined in a side of the cover 20 corresponding to the receiving chamber 12 of the base 10. The cover 20 has a sliding section 23 on each longitudinal side for sliding along the guiding sections 13 of the base 10. A pair of hooks (not shown) extends downwardly from the bottom of the cover 20 on two sides of the through aperture 22 for passing through the through slots 16 of the base 10 to latch on the base 10.

Figure 3:
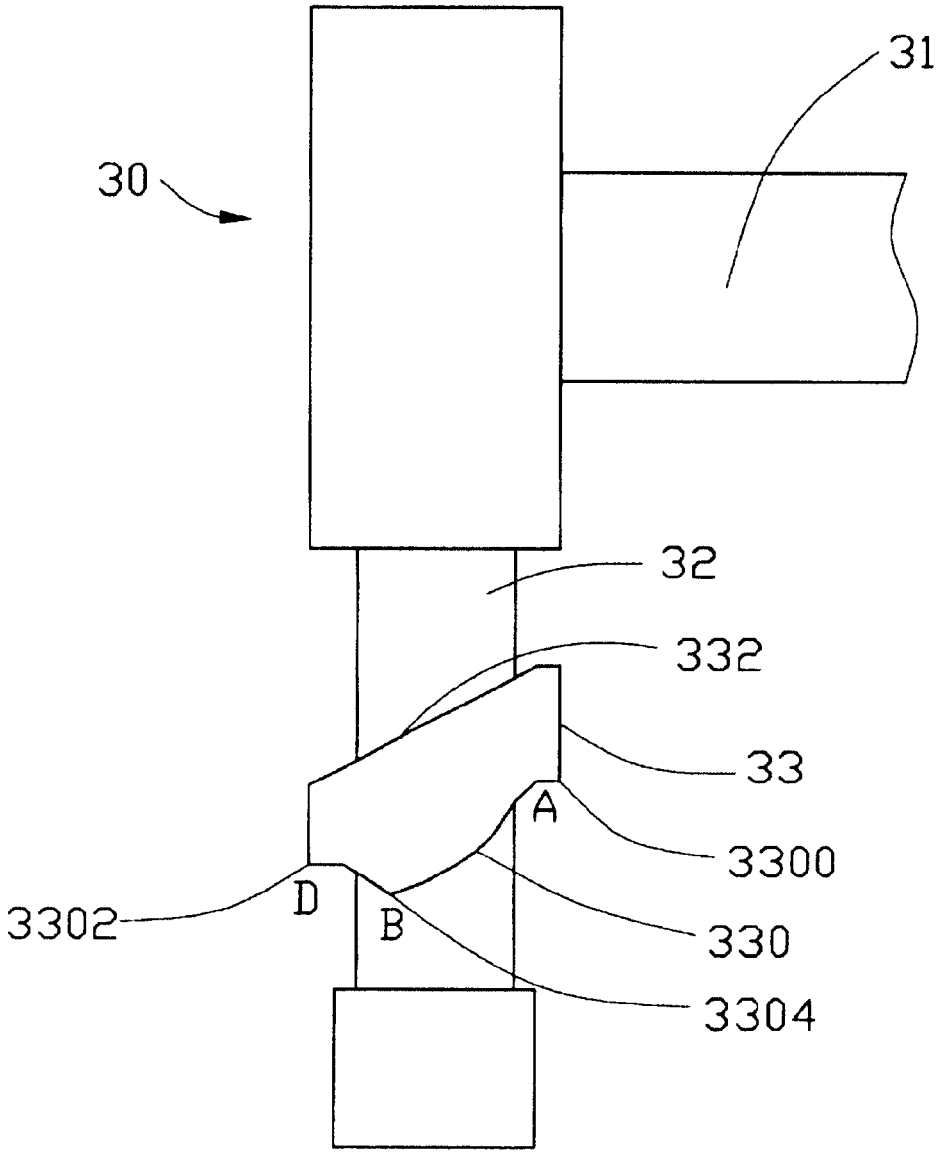
FIG. 3 is an enlarged schematic view of an actuation member of the ZIF socket of FIG. 1.

Referring to FIGS. 1 and 3 simultaneously, the actuation member 30 includes a cam shaft 32 and an operating handle 31 perpendicularly extending from the cam shaft 32 for being respectively received in the receiving chamber 12 and the receiving slot 14 of the base 10. The cam shaft 32 has a cam member 33 and the cam member 33 has a driving side 330 for driving the cover 20 to move with respect to the base 10 and a plane side 332 opposite to the driving side 330. The shape of the driving side 330 directly affects the displacement of the cover 20 relative to the base 10. The driving side 330 is not a plane but a scraggy surface. The driving side 330 provides a start portion 3300 at one end thereof, an end portion 3302 at the other end thereof, and a tip portion 3304 between the start portion 3300 and the end portion 3302. From the start portion 3300 to the end portion 3302 of the driving side 330, the distances between the driving side 330 and the plane side 332 are different. The distance from the tip portion 3304 of the driving side 330 to the plane side 332 is a maximum distance, while the distance from either the start portion 3300 or the end portion 3302 of the driving side 330 to the plane side 332 is smaller than the maximum distance. From the start portion 3300 to the tip portion 3304 of the driving side, the distances between the driving side 330 and the plane side 332 increases approximately and gradually; from the tip portion 3304 to the end portion 3302 of the driving side 330, the distances between the driving side 330 and the plane side 332 begin to decrease approximately and gradually. Furthermore, the operating handle 31 provides a curved portion 310 to engage with the stopping post 19 of the base 10 to retain the actuation member 30 in a closed position of the socket 1.

Referring to FIG. 1 again, several components of the socket 1 are shown, which include a cover plate 40, a shaft clip 50 and a pair of latch plates 60. The cover plate 40, made of metal, is fixed to the through aperture 22 of the cover 20 by insert molding. An opening 41 is defined in the cover plate 40 for insertion of the cam member 33 of the actuation member 30 therein. The shaft clip 50 is inserted into the receiving slit 15 of the base 10 and abuts against an end of the cam shaft 32 for fixing the actuation member 30 in position. The pair of latch plates 60 is upwardly inserted into the through slots 16 of the base 10 and engage with the hooks at the bottom of the cover 20 for preventing the cover 20 from separating from the base 10.

Figure 2:
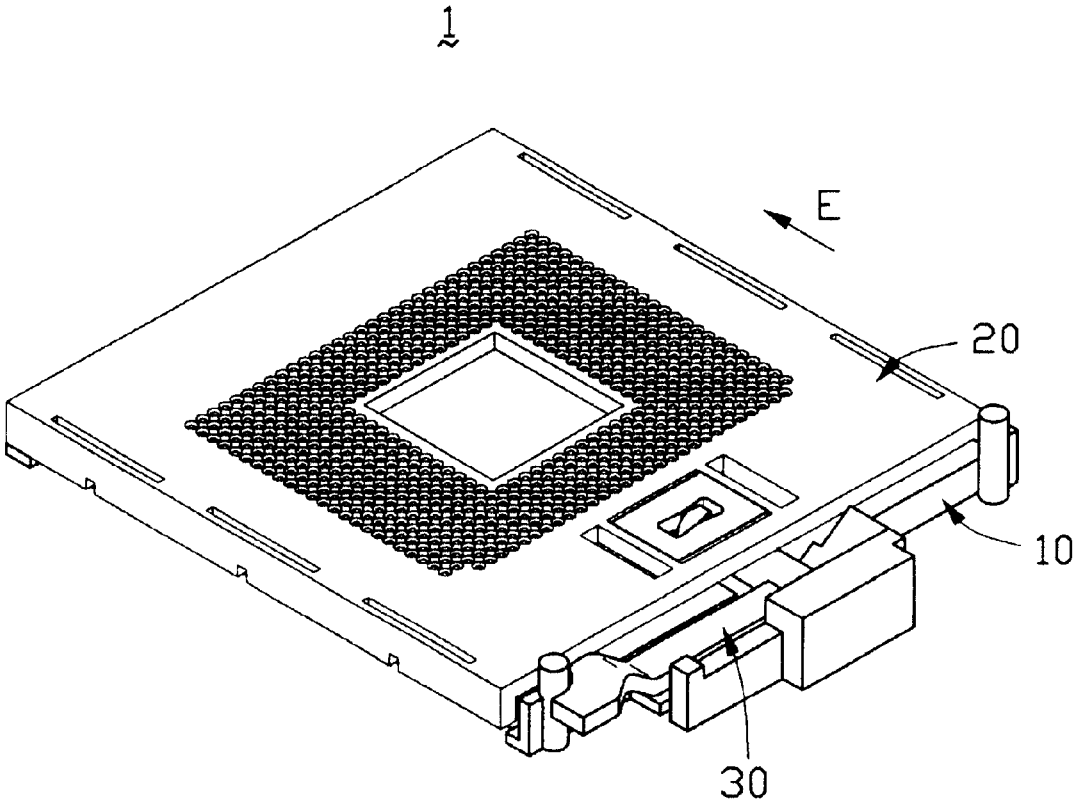
FIG. 2 is an assembled view of FIG. 1.
Figure 4:
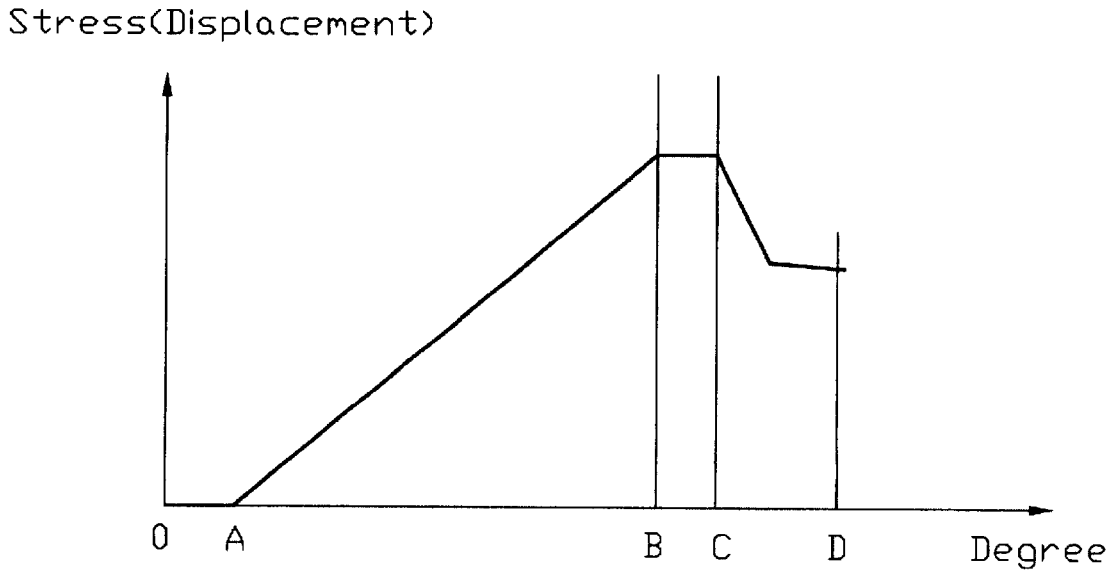
FIG. 4 is a diagram illustrating the relation between a displacement of a cover relative to a base/a contact stress between a cam member of the actuation member and a cover plate of a cover, and a rotated angle of the actuation member of the ZIF socket of the present invention.
Figure 5:
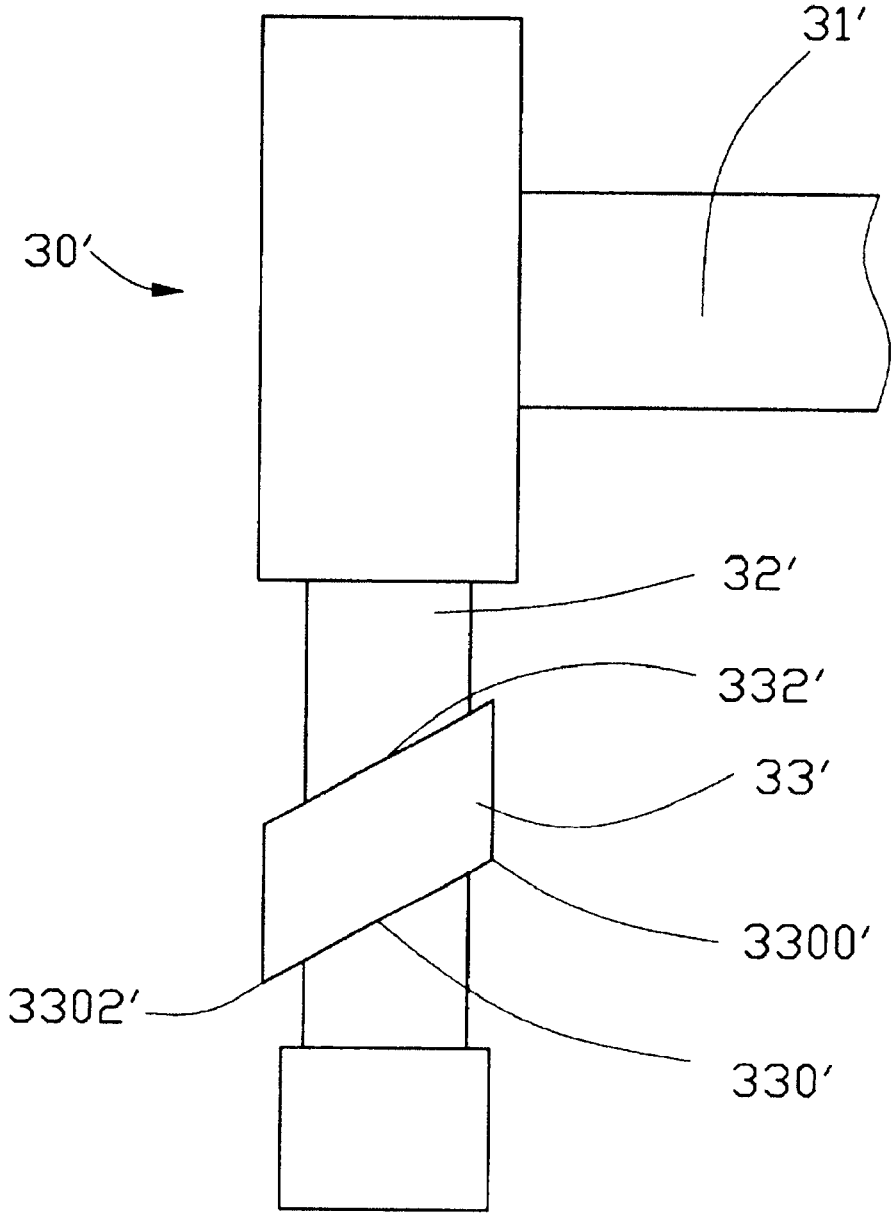
FIG.5 (PRIOR ART)
FIG. 5 is an enlarged schematic view of a conventional actuation member.
Figure 6:
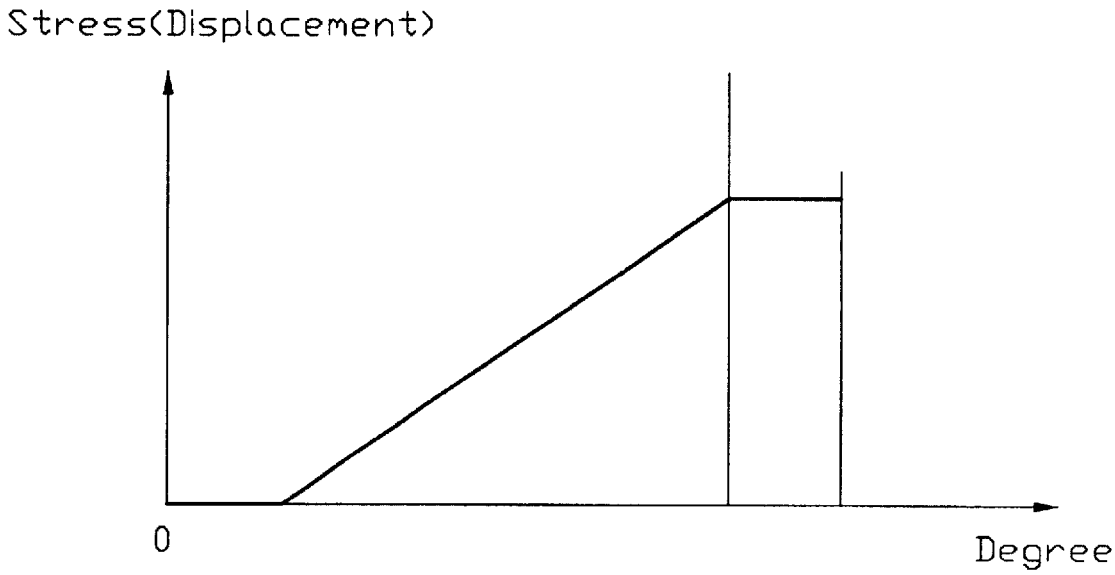
FIG.6 (PRIOR ART)
FIG. 6 is a diagram similar to FIG. 4, but illustrating the relation between a displacement of a cover relative to a base/a contact stress between a cam member of the conventional actuation member and a cover plate of a cover, and a rotated angle of the conventional actuation member.

In use, referring to FIGS. 2 to 4, when the ZIF socket 1 is in an open position, in which the operating handle 31 of the actuation member 30 is in a zero degree position or its original position where the operating handle 31 is oriented in a vertical direction or engages with the inclined block 18, the pin holes 21 of the cover 20 are vertically aligned with the terminal passageways 11 of the base 10 such that the pins of the CPU package can be freely inserted through the pin holes 21 into the terminal passageways 11. At this position, the displacement of the cover 20 relative to the base 10 is zero. When the operating handle 31 of the actuation member 30 is rotated from the zero degree position to an "A" degree position, the cover 20 is not pushed to move due to a clearance between the cam member 33 and the cover plate 40. Thus, the displacement of the cover 20 relative to the base 10 is still zero, and a contact stress between the cam member 33 of the actuation member 30 and the cover plate 40 is also zero. By further rotating the operating handle 31 of the actuation member 30 towards its final, horizontal position, the cover 20 is thus pushed to move horizontally with respect to the base 10 along an "E" direction and the displacement of the cover 20 relative to the base 10 increases gradually. The pins of the CPU package begin to move to mechanically and electrically connect with the conductive contacts 70 of the socket 1. The pushing force of the cam member 33 acting on the cover plate 40 increases following the increase of the displacement of the cover 20 relative to the base 10 during the rotation of the actuation member 30 from the position "A" to a position "B", whereby the contact stress also increases gradually. When the operating handle 31 is rotated to the "B" degree position that is about 10 to 20 degrees relative to its final position, that is, the cam member 33 is rotated to make the tip portion 3304 of the driving side 330 bear against an inner side of the opening 41 of the cover plate 40, the displacement of the cover 20 relative to the base 10 attains a maximum, and accordingly the contact stress arrives at a top peak. When the operating handle 31 is further rotated from the "B" degree position to a "C" degree position, the displacement of the cover 20 relative to the base 10 and the contact stress remain unchanged. When the operating handle 31 is continually rotated from the "C" degree position towards its horizontal position, the tip portion 3304 of the driving side 330 of the cam member 33 starts to slim over the inner side of the opening 41 of the cover plate 40. The cover 20 begins to move in a direction opposite to the "E" direction and the displacement of the cover 20 relative to the base 10 starts to decrease gradually. Accordingly, the contact stress also reduces gradually. When the operating handle 31 is rotated to a "D" degree position or its final, horizontal position, that is, the socket is in a closed position, the end portion 3302 of the driving side 330 of the cam member 33 bears against the inner side of the opening 41 of the cover plate 40. At this time, the displacement of the cover 20 relative to the base 10 is obviously smaller than that of the "B" degree position and accordingly the contact stress is released. In this situation, even if the socket is subject to a high temperature environment, the cam member 33 does not have a problem of creep. Therefore, the ZIF socket 1 ensures an effective and reliable connection between the pins of the CPU package and the conductive contacts 70 of socket 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical socket for supporting an integrated circuit chip to electrically connect to a circuit board, comprising:

a dielectric base defining an array of terminal passageways and a receiving chamber in a top surface thereof;

a plurality of conductive contacts received in the terminal passageways;

a cover slidably mounted on the dielectric base, the cover defining an array of pin holes vertically aligned with the terminal passageways adapted for insertion of pins of the integrated circuit chip therethrough and an through aperture corresponding to said receiving chamber; and an actuation member moving the cover with respect to the dielectric base in a lengthwise direction, the actuation member comprising a cam shaft received in said receiving chamber, said cam shaft having an axis parallel to the lengthwise direction and a cam member, the cam member providing a driving side and a plane side opposite to the driving side, the driving side having a start portion at one end thereof, an end portion at the other end thereof, and a tip portion between said start portion and said end portion; wherein said driving side extends in an oblique manner relative to said lengthwise direction, and includes a transversely straight section at the end portion of the driving side so as to maintain the cover at a stable/immoveable position relative to the base at a final moment of rotation of said actuation member;

wherein the distance from said tip portion of the driving side to the plane side is a maximum distance, while the distance from said end portion of the driving side to the plane side is smaller than the maximum distance.

2. The electrical socket as claimed in claim 1, wherein the actuation member includes an operating handle vertically extending from the cam shaft.

3. The electrical socket as claimed in claim 2, wherein the base defines a receiving slot in communication with said receiving chamber for receiving said operating handle of the actuation member.

4. The electrical socket as claimed in claim 3, further comprising a cover plate defining an opening therein, the cover plate being disposed in the through aperture of the cover.

5. The electrical socket as claimed in claim 4, wherein a displacement of the cover relative to the base is zero and accordingly a contact stress between the cam member of the actuation member and the cover plate is also zero when the socket is in an open position, that is, the operating handle is in an original position.

6. The electrical socket as claimed in claim 5, wherein the displacement of the cover relative to the base attains a maximum displacement and accordingly the contact stress arrives at a top peak when the operating handle is rotated to make the tip portion of the driving side of the cam member bear against an inner side of the opening of the cover plate.

7. The electrical socket as claimed in claim 6, wherein the displacement of the cover relative to the base is smaller than said maximum displacement when the operating handle is rotated to a final position, that is, the socket is in a closed position.

8. The electrical socket as claimed in claim 7, wherein a rotated angle of the operating handle is about 10 to 20 degrees relative to its final position when the operating handle is rotated to make the tip portion of the driving side of the cam member bear against the inner side of the opening of the cover plate.

* * * * *